US007824064B2

(12) United States Patent
Oyama

(10) Patent No.: US 7,824,064 B2
(45) Date of Patent: Nov. 2, 2010

(54) LIGHTING APPARATUS

(75) Inventor: Nobuo Oyama, Tokyo (JP)

(73) Assignee: Kabushiki Kaisha S.T.I. Japan, Tokyo (JP)

( * ) Notice: Subject to any disclaimer, the term of this patent is extended or adjusted under 35 U.S.C. 154(b) by 0 days.

(21) Appl. No.: 11/878,446

(22) Filed: Jul. 24, 2007

(65) Prior Publication Data

US 2009/0027877 A1 Jan. 29, 2009

(51) Int. Cl.
*F21V 21/00* (2006.01)

(52) U.S. Cl. ..... 362/217.14; 362/217.16; 362/223

(58) Field of Classification Search ..... 362/147, 362/260, 217, 219, 221, 222, 223, 225, 217.14, 362/217.15, 217.16
See application file for complete search history.

(56) References Cited

U.S. PATENT DOCUMENTS 2,399,531 A * 4/1946 Young ..... 439/234
2,474,308 A * 6/1949 Franck et al. ..... 362/224
2,827,555 A * 3/1958 Woolley ..... 362/132
3,944,807 A * 3/1976 Frantti et al. ..... 362/217.15
4,070,571 A * 1/1978 Robertson et al. ..... 362/217.08
4,336,576 A * 6/1982 Crabtree ..... 362/240
5,884,994 A * 3/1999 Herst et al. ..... 362/256
6,186,642 B1 * 2/2001 Corcorran et al. ..... 362/219
6,206,548 B1 * 3/2001 Lassovsky ..... 362/283

* cited by examiner

*Primary Examiner*—John A Ward
(74) *Attorney, Agent, or Firm*—Wenderoth, Lind & Ponack, L.L.P.

(57) ABSTRACT

A lighting apparatus includes at least one rigid elongated cylindrical structure having a longitudinal axis, and a plurality of rigid plate-like structures fixed to the cylindrical structure such that each of the plate-like structures is perpendicular to the longitudinal axis. Also, at least one straight fluorescent tube is mounted to at least either the cylindrical structure or the plate-like structures.

20 Claims, 7 Drawing Sheets

LIGHTING APPARATUS

BACKGROUND OF THE INVENTION

1. Field of the Invention

The present invention relates to a lighting apparatus, in particular, to its structure with a straight fluorescent tube.

2. Description of the Related Art

In view of energy saving required today, most of fluorescent lighting apparatus are required to increase energy efficiency thereof without deteriorating eyeshot environment. For example, JP 2004-134330 A proposes a lighting apparatus which improves energy efficiency by preventing the rise of circumferential temperature of a fluorescent tube.

However, a main body of the lighting apparatus disclosed in JP 2004-134330 A has a box shape structure which comprises a bottom plate and four side plates. This results in a structure that is low in rigidity and is easy to deform or distort.

These days, as a fluorescent tube having an excellent potential on the energy saving, a high-intensity fluorescent tube having a diameter of approximately 16 mm with its light emitting efficiency improved by 20% compared to that of a conventional fluorescent tube is being manufactured and supplied. However, the box-shaped lighting apparatus as described in JP 2004-134330 A does not have enough rigidity to support such a fluorescent tube having a small diameter.

SUMMARY OF THE INVENTION

The present invention has been made to solve the above-mentioned problem, and therefore it is an object of the present invention to provide a lighting apparatus having excellent rigidity.

A lighting apparatus according to the present invention includes: a rigid elongated cylindrical structure having rigid plate-like structures fixed to the cylindrical structure such that each of the plate-like structures is perpendicular to the longitudinal axis of the cylindrical structure; and a straight fluorescent tube or straight fluorescent tubes mounted to at least the cylindrical structure or the plate-like structures.

DETAILED DESCRIPTION OF THE PREFERRED EMBODIMENTS

Hereinafter, embodiments of the present invention are described referring to the accompanying drawings.

Embodiment 1

Figure 1:
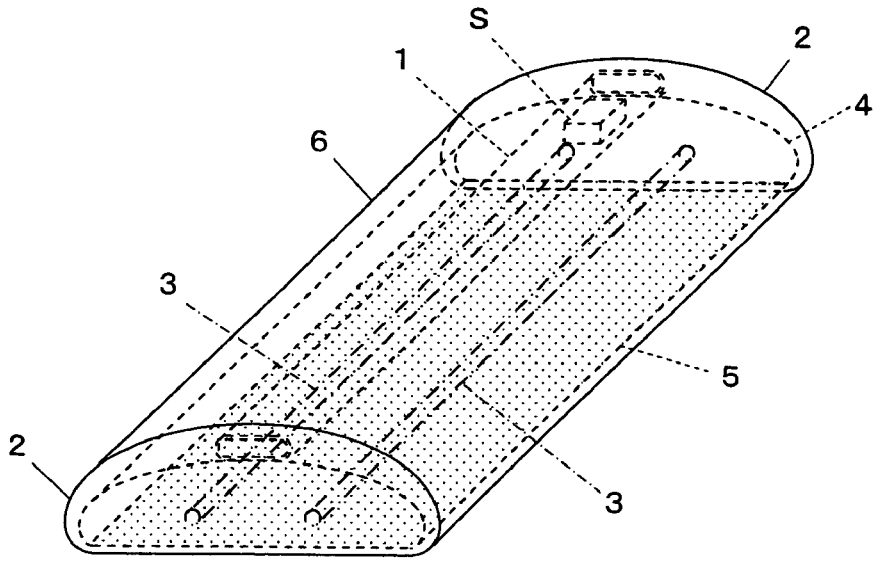
FIG. 1 is a perspective view illustrating a structure of a lighting apparatus according to a first embodiment of the present invention.

FIG. 1 illustrates a structure of a lighting apparatus according to a first embodiment of the present invention. Rigid plate-like structures 2 are fixed to both ends of an elongated cylindrical structure 1 such that each of the plate-like structures 2 is perpendicular to the longitudinal axis of the cylindrical structure 1. Two straight fluorescent tubes 3 are disposed between the plate-like structures 2.

The two fluorescent tubes 3 are disposed in parallel to the longitudinal axis of the cylindrical structure 1. A first reflection body 4 is mounted between the cylindrical structure 1 and the fluorescent tubes 3 so as to extend toward sides of both the fluorescent tubes 3. A panel-like transparent light diffusion body 5 is provided to cover a portion below the fluorescent tubes 3. Further, a portion above the first reflection body 4 is covered with a cover member 6.

Figure 2:
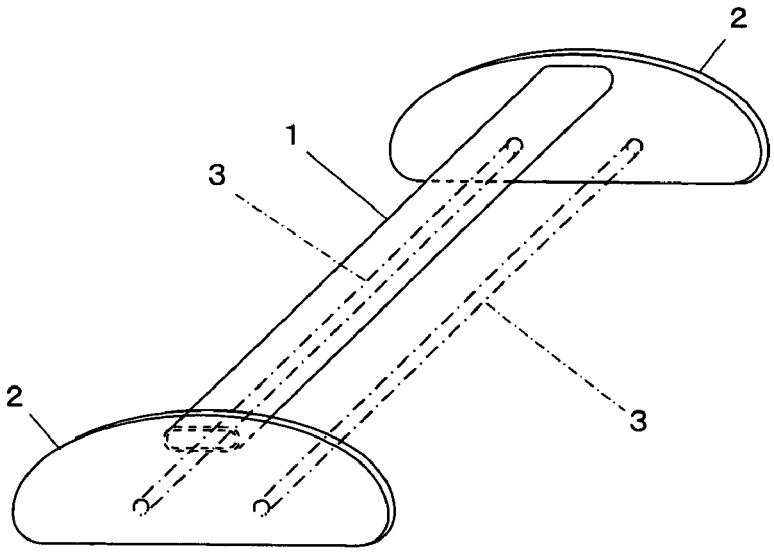
FIG. 2 is a perspective view illustrating a framework of the lighting apparatus according to the first embodiment.

In the lighting apparatus, as shown in FIG. 2, high rigidity is secured due to the cylindrical structure 1 and the pair of plate-like structures 2 fixed to both ends of the cylindrical structure 1. Thus, the straight fluorescent tubes 3 can be firmly supported between the plate-like structures 2. Accordingly, the high-intensity fluorescent tubes 3 each having a diameter of approximately 16 mm can be used.

Further, the first reflection body 4, the transparent light diffusion body 5 and a cover member 6 are held by the plate-like structures 2 so as to be bridged therebetween.

Figure 3:
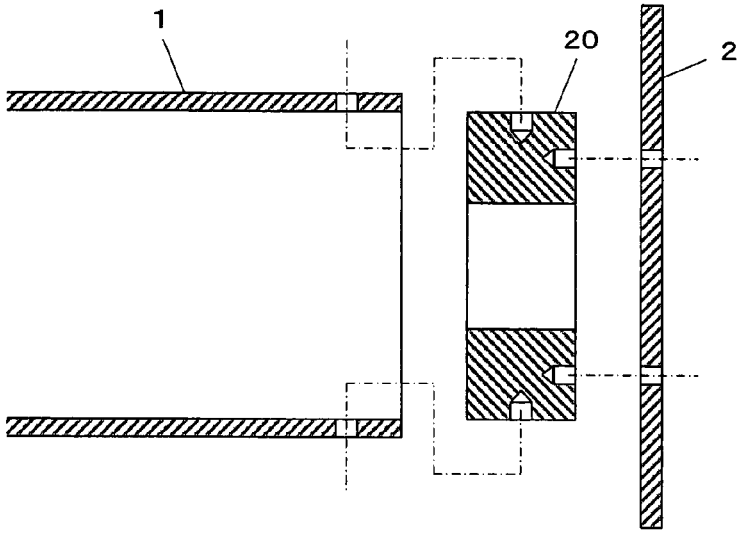
FIG. 3 is a cross-sectional view illustrating how a cylindrical structure is fixed to a plate-like structure.

As shown in FIG. 3, a fixation ring 20 is inserted into an end portion of the cylindrical structure 1, the fixation ring 20 is fixed by using screws (not shown) from an outer-side of the cylindrical structure 1, and the plate-like structure 2 is fixed to an end surface of the fixation ring 20 by using screws (not shown). Accordingly, the cylindrical structure 1 and the plate-like structural body 2 can be fixed to each other.

Figure 4:
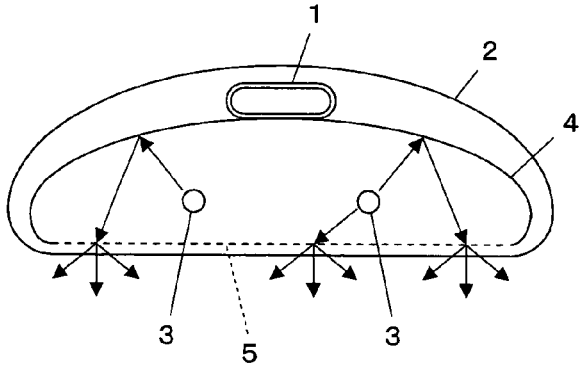
FIG. 4 is a cross-sectional view illustrating the lighting apparatus according to the first embodiment.

As shown in FIG. 4, light emitted from each of the fluorescent tubes 3 enters the transparent light diffusion body 5 directly or after being reflected by the first reflection body 4. Then the light is diffused by the transparent light diffusion body 5 and radiated out to an irradiation region, downward.

A ballast for lighting the fluorescent tubes 3 may be placed inside the cylindrical structure 1. With such arrangement, the lighting apparatus is downsized.

The transparent light diffusion body 5 is not necessarily provided. When glare of the fluorescent tubes 3 is not recognized, the fluorescent tubes 3 may be exposed downwardly without providing the transparent light diffusion body 5.

As described above, since the lighting apparatus has rigidity due to the cylindrical structure 1 and the plate-like structures 2, the cover member 6 may be formed of a sheet-like member, for example, and only needs to cover an upper portion of the first reflection body 4. Hence, the cover member 6 does not need to be provided if it is not required from a viewpoint of design.

Figure 5:
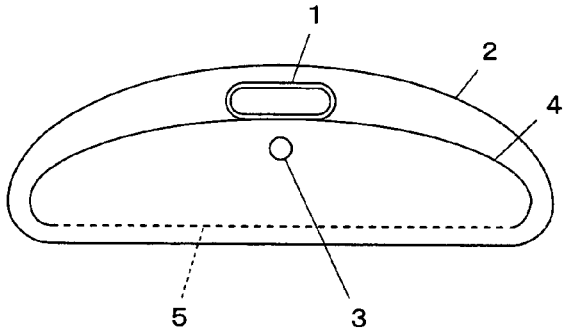
FIG. 5 is a cross-sectional view illustrating a lighting apparatus according to a modified example of the first embodiment.

Note that, as shown in FIG. 5, only one straight fluorescent tube 3 may be provided between the pair of plate-like structures 2.

Embodiment 2

Figure 6:
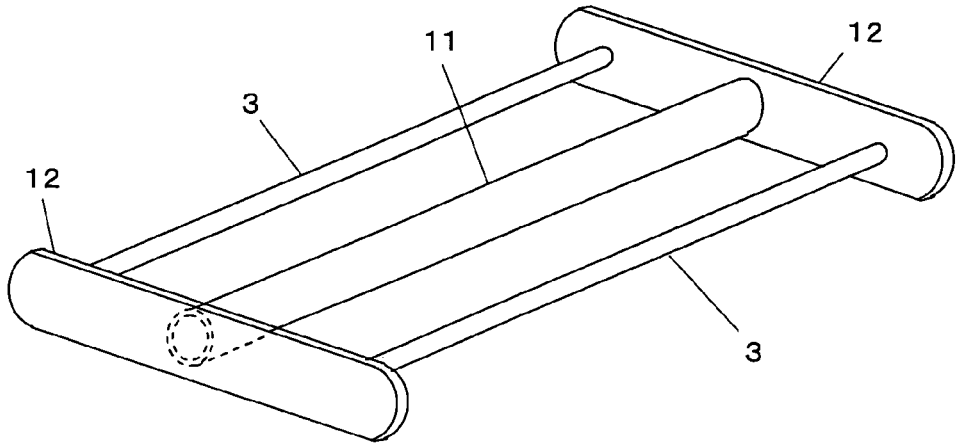
FIG. 6 is a perspective view illustrating a framework of a lighting apparatus according to a second embodiment of the present invention.
Figure 7:
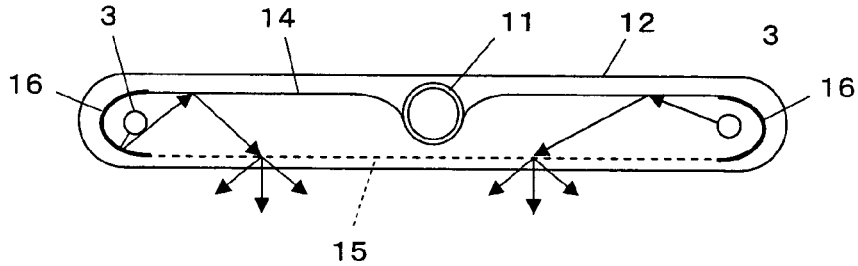
FIG. 7 is a cross-sectional view illustrating the lighting apparatus according to the second embodiment.

FIG. 6 illustrates a framework of a lighting apparatus according to a second embodiment of the present invention. Rigid plate-like structures 12 are fixed to both ends of an elongated cylindrical structure 11 such that each of the plate-like structures 12 is perpendicular to a longitudinal axis of the cylindrical structure 11. The two straight fluorescent tubes 3 are mounted to the plate-like structures 12 so as to be bridged therebetween. The fluorescent tubes 3 are disposed on both sides of the cylindrical structure 11 and in the vicinity of left and right end portions of the plate-like structures 12. As shown in FIG. 7, a first reflection body 14 is provided from a portion above one of the fluorescent tubes 3 to a portion above another one of the fluorescent tubes 3 passing under the cylindrical structure 11.

Second reflection bodies 16 for reflecting light emitted from the fluorescent tubes 3 toward an inner portion of the lighting apparatus are provided at end portions of the plate-like structures 12 outside of (the arrangement of) the fluorescent tubes 3. The second reflection bodies 16 extend to portions directly below the fluorescent tubes 3 and prevent the light emitted from the fluorescent tubes 3 from directly radiating downward and out. Thus, most portions of the fluorescent tubes 3 are hidden behind the second reflection bodies 16 at edge portions of the lighting apparatus. Accordingly, even in a case where the high-intensity fluorescent tubes, each having a diameter of approximately 16 mm, are used as the fluorescent tubes 3, highly uniform radiation can be obtained without generating light and dark bands on the radiation surface.

Further, a panel-like transparent light diffusion body 15 is mounted between lower end portions of the left and right second reflection bodies 16.

Each of the second reflection bodies 16 reflects the light emitted from each of the fluorescent tubes 3 toward the inner portion of the lighting apparatus in a range of a solid angle of $2\pi$ radian. Specular reflection bodies can be used as the second reflection bodies 16. As structured above, a lighting apparatus having increased radiation efficiency and excellent energy efficiency is realized.

Similarly to the lighting apparatus according to the first embodiment of the present invention, in the lighting apparatus according to the second embodiment of the present invention, high rigidity is secured due to the cylindrical structure 11 and the pair of plate-like structures 12 fixed to the both ends of the cylindrical structure 11. Thus, the straight fluorescent tubes 3 can be firmly supported by the plate-like structures 12 so as to be bridged therebetween.

As shown in FIG. 7, light emitted from each of the fluorescent tubes 3 enters the transparent light diffusion body 15 directly or after being reflected by at least one of the first reflection body 14 and the second reflection bodies 16. The light is then diffused by the transparent light diffusion body 15 and radiated downwardly out to the irradiation region.

Figure 8A:
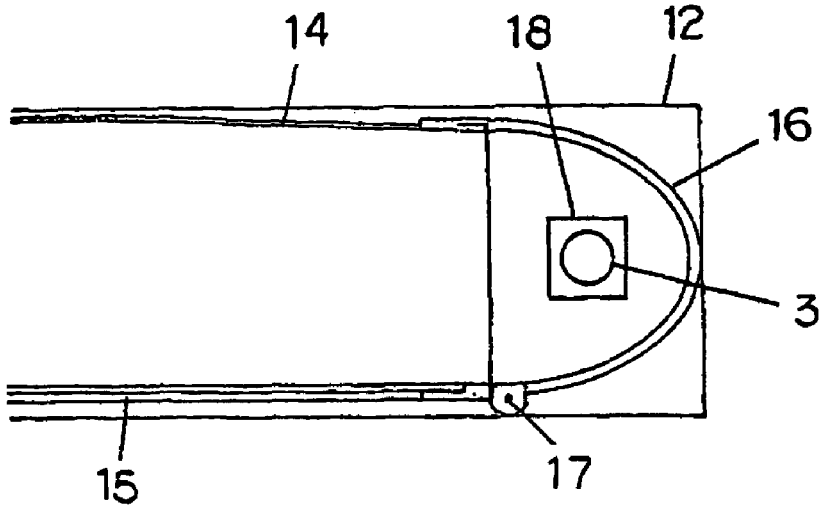
FIGS. 8A and 8B are partially-enlarged cross-sectional views of the lighting apparatus according to the second embodiment showing the state that a second reflection body is closed and the state that the second reflection body is open, respectively.
Figure 8B:
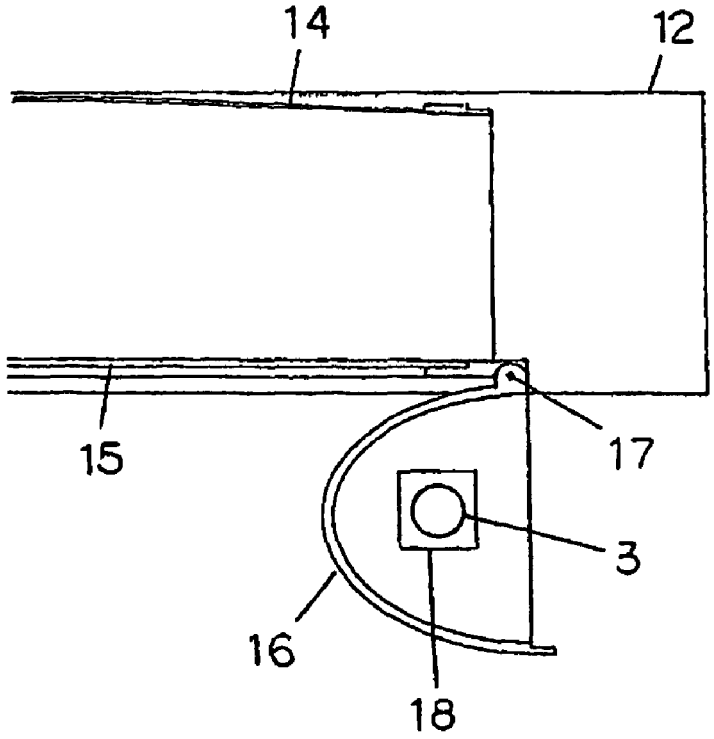

As shown in FIG. 8A, when the entire second reflection body 16 or a part thereof is structured by using a hinge 17 so as to be able to open, and a socket 18 for supporting an electrode of the fluorescent tube 3 is provided to a side of such openable second reflection body 16. Then, in a state where the second reflection body 16 is open as shown in FIG. 8B, the fluorescent tube 3 can be readily mounted to/dismounted from the lighting apparatus without detaching the transparent light diffusion body 15. Note that the socket 18 may be provided not to the side of the second reflection body 16 but to the plate-like structures 12.

Figure 9:
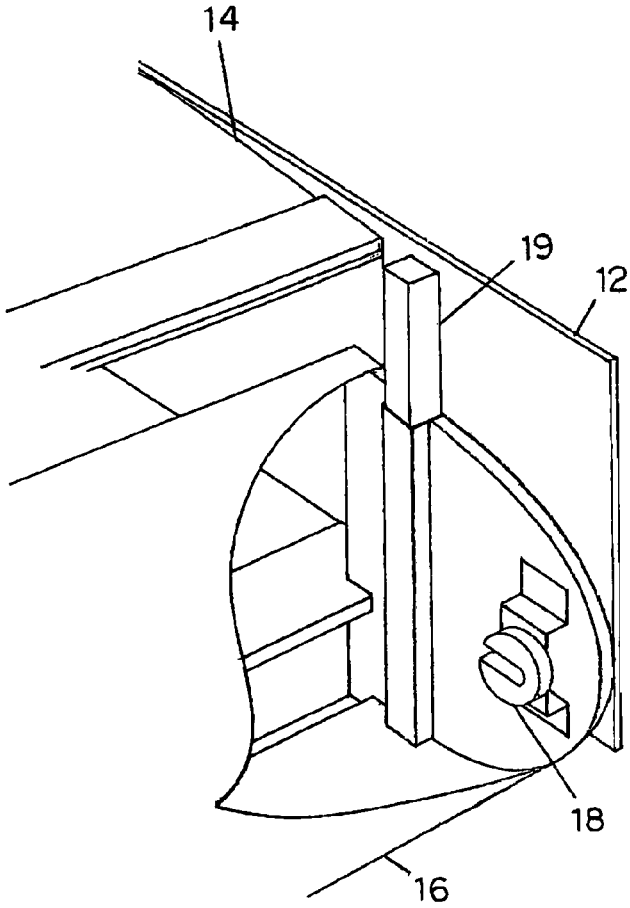
FIG. 9 is a cut-away of a perspective view illustrating a lighting apparatus according to a first modified example of the second embodiment.

Further, in a case where the second reflection body 16 is structured so as to be slidable downward with respect to the plate-like structures 12 together with the socket 18 along a guiding member 19 as shown in FIG. 9, the fluorescent tube 3 can be readily mounted to/detached from the lighting apparatus without detaching the transparent light diffusion body 15.

Figure 10:
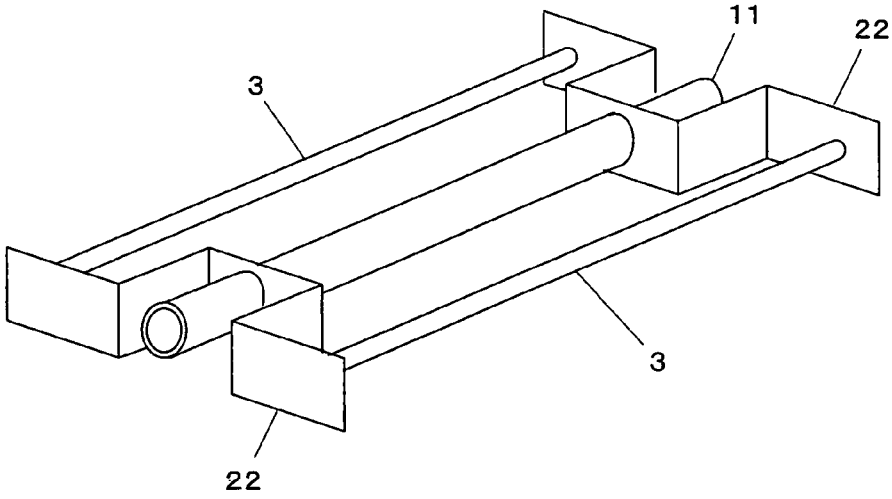
FIG. 10 is a perspective view illustrating a framework of a lighting apparatus according to a second modified example of the second embodiment.
Figure 11:
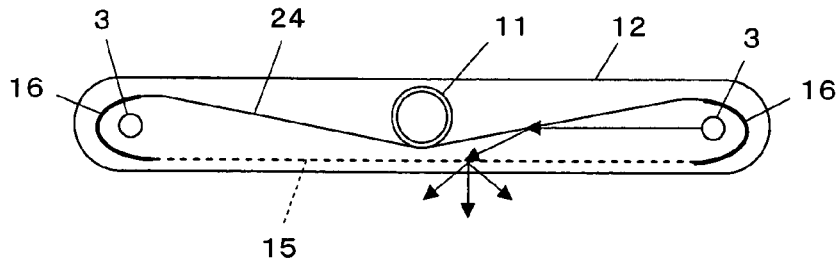
FIGS. 11 to 13 are cross-sectional views illustrating lighting apparatuses according to third to fifth modified examples of the second embodiment, respectively.

Note that in the lighting apparatus according to Embodiment 2 shown in FIG. 6, each of the flat plate-like structures 12 is fixed to each end portion of the cylindrical structure 11. Alternatively as shown in FIG. 10, in the case where a lighting apparatus is structured such that the cylindrical structure 11 is caused to penetrate and fix bent plate-like structures 22, rigidity of the entire lighting apparatus can be further increased.

Instead of using the first reflection body 14 having a substantially horizontal surface as shown in FIG. 7, there may be used a first reflection body 24 having inclined surfaces from the portions above the fluorescent tubes 3 to the lower end portion of the cylindrical structural body 11. As structured above, light emitted from each of the fluorescent tubes 3 in a substantially horizontal direction toward the cylindrical structure 11 is reflected by the first reflection body 24 to enter the transparent light diffusion body 15, for example.

Figure 12:
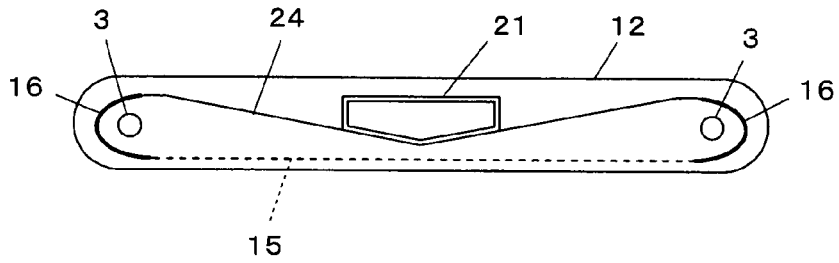

Further, instead of using the cylindrical structure 11, there may be used a rectangular pipe-like structure 21 as shown in FIG. 12.

Figure 13:
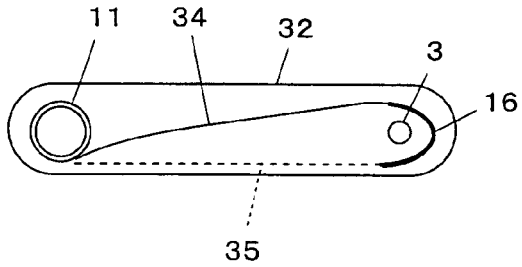

Further, as shown in FIG. 13, only one straight fluorescent tube 3 may be disposed between a pair of plate-like structures 32 fixed to the both ends of the cylindrical structure 11. A first reflection body 34 forming an inclined surface from the portion above the fluorescent tube 3 to the lower end portion of the cylindrical structure 11 is provided, and a panel-like transparent light diffusion body 35 is provided at the lower end portion of the second reflection body 16 and the lower end portion of the cylindrical structure 11 so as to be bridged therebetween.

High rigidity is secured due to the cylindrical structure 11 and the pair of plate-like structures 32 fixed to the both ends of the cylindrical structure 11.

A ballast used for lighting the fluorescent tubes 3 may be disposed so as to be stored inside the cylindrical structure 11 or 21 so that the lighting apparatus is downsized.

Further, the transparent light diffusion body 15 or 35 is not necessarily provided.

Embodiment 3

Figure 14:
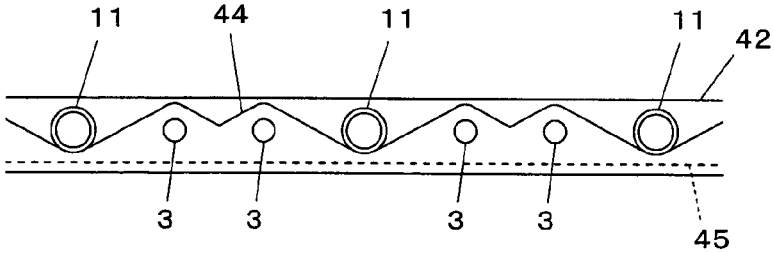
FIG. 14 is a cross-sectional view illustrating a lighting apparatus according to a third embodiment of the present invention.

FIG. 14 illustrates a cross section of a lighting apparatus according to a third embodiment of the present invention. The plurality of elongated cylindrical structures 11 having rigidity are disposed in parallel so as to be spaced apart from each other by predetermined intervals. Rigid plate-like structures 42 are fixed to both ends of each of the cylindrical structures 11 such that each of the plate-like structures 42 is perpendicular to a longitudinal axis of each cylindrical structure 11. A plurality of fluorescent tubes 3 is disposed in parallel to the longitudinal axis of each cylindrical structure 11 between the adjacent cylindrical structures 11. Each of the fluorescent tubes 3 is mounted to the pair of plate-like structures 42 so as to be bridged therebetween. Portions above the fluorescent tubes 3 are provided with a first reflection body 44, and a panel-like transparent light diffusion body 45 is provided below the fluorescent tubes 3.

High rigidity is secured due to the plurality of cylindrical structures 11 and the pair of plate-like structures 42. Thus, the plurality of straight fluorescent tubes 3 can be firmly supported by the plate-like structures 42 so as to be bridged therebetween.

Figure 15:
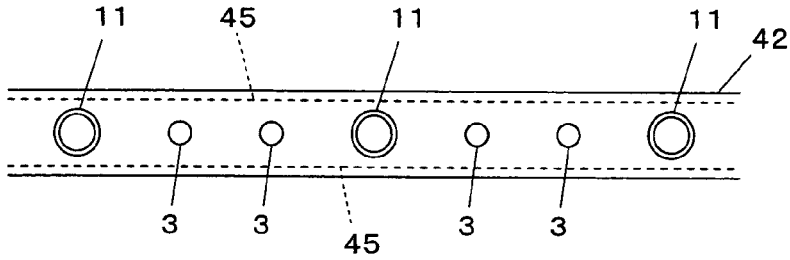
FIG. 15 is a cross-sectional view illustrating a lighting apparatus according to a modified example of the third embodiment.

Further, without providing the first reflection body 44 above the fluorescent tubes 3, the panel-like transparent light diffusion body 45 may be alternatively provided above the fluorescent tubes 3 as shown in FIG. 15. That is, the fluorescent tubes 3 are placed between the pair of panel-like transparent light diffusion bodies 45. As structured above, apart of the light emitted from each of the fluorescent tubes 3 can be radiated out downward, and the rest can be radiated out upward.

Embodiment 4

Figure 16:
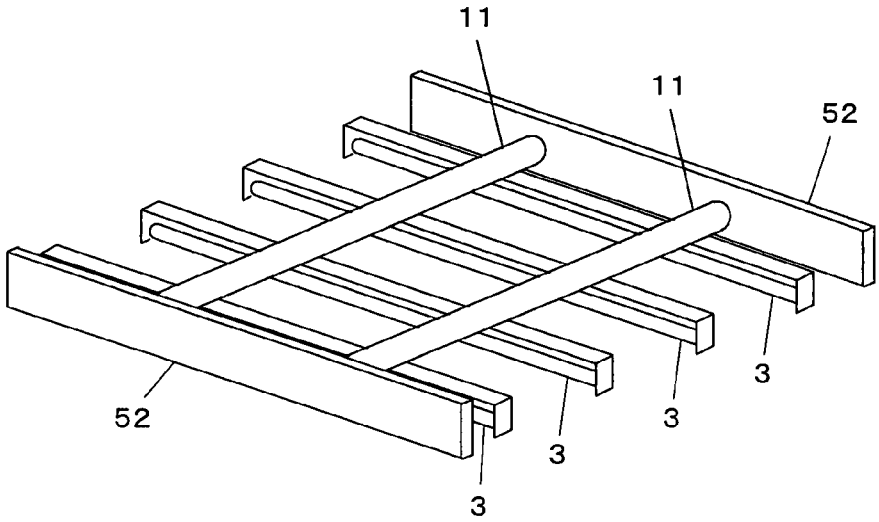
FIG. 16 is a perspective view illustrating a framework of a lighting apparatus according to a fourth embodiment of the present invention.
Figure 17:
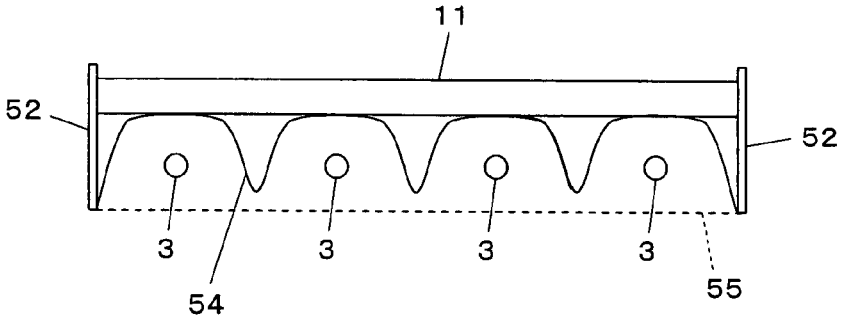
FIG. 17 is a cross-sectional view illustrating the lighting apparatus according to the fourth embodiment.

FIG. 16 illustrates a framework of a lighting apparatus according to a fourth embodiment of the present invention. Rigid plate-like structures 52 are fixed to both ends of the two elongated cylindrical structures 11 having rigidity such that each of the plate-like structures 52 is perpendicular to a longitudinal axis of each of the elongated cylindrical structures 11. The four fluorescent tubes 3 are mounted to the two cylindrical structures 11 so as to be perpendicular to the longitudinal axes thereof, that is, so as to extend in parallel to the plate-like structures 52. As shown in FIG. 17, a first reflection body 54 is provided above the fluorescent tubes 3, and a panel-like transparent light diffusion body 55 is provided below the fluorescent tubes 3.

A high degree of rigidity is secured due to the two cylindrical structures 11 and the pair of plate-like structures 52. Thus, the plurality of straight fluorescent tubes 3 can be firmly supported by the cylindrical structures 11.

Similarly, the framework of the lighting apparatus may be structured by using the three or more cylindrical structures 11 and the pair of plate-like structures 52. Further, the number of the fluorescent tubes 3 is not limited to four, but five or more fluorescent tubes 3 can be provided.

Embodiment 5

The first reflection body 4, 14, 24, 34, 44 or 54 according to each of the above-described may be imparted with a reflecting diffusion function. As structured above, a higher degree of uniformity can be obtained with the radiation surface, so that the inside of the lighting apparatus is hard to be viewed by a user below the lighting apparatus through the transparent light diffusion body 5, 15, 35, 45 or 55. A portion, inside of the lighting apparatus, closer to the transparent light diffusion body is likely to be viewed. Hence, it is preferable that, at least, a surface portion of the first reflection body 4, 14, 24, 34, 44 or 54 closer to the transparent light diffusion body is imparted with a reflecting diffusion function. Similarly, it is preferable that, at least, a surface portion of each of the cylindrical structures 11 closer to the transparent light diffusion body of the lighting apparatus shown in FIG. 15 is imparted with the reflecting diffusion function.

Such reflecting diffusion function to be imparted to the first reflection body may be an omnidirectional/scattered diffusion with which reflected light is visually recognized as white. Alternatively, in a case where most part of light is diffused only in a limited direction by the transparent light diffusion body, the first reflection body may diffuse most of the light at least in a direction crossing such limited direction. In particular, as shown in FIGS. 7 and 11 to 14, in the structure in which the interval between the first reflection body and the transparent light diffusion body gets smaller as the light emitted from each of the fluorescent tubes 3 travels, it is preferable that the limited direction of the main diffusion by the transparent light diffusion body crosses the limited direction of the main diffusion by the first reflection body. As a result, energy is prevented from being attenuated, and a uniform radiation surface can be obtained.

For example, in FIG. 7, 11, 12, 13 or 14, it is assumed a case where the transparent light diffusion body 5, 15, 35 or 45 has a number of parallel ridges or grooves aligned in a direction parallel to longitudinal axes of the fluorescent tubes 3 or crossing thereto. In this case, it is preferable that at least the surface portion of the first reflection body 4, 14, 24, 34 or 44 closer to the transparent light diffusion body is imparted with a reflecting diffusion function by forming a number of parallel ridges or grooves aligned (parallel to each other) in a direction crossing the ridges or grooves of the transparent light diffusion body.

As the panel-like transparent light diffusion body, one comprising a number of fine ridges or grooves on at least one of the surfaces thereof so as to be in parallel and to contact one another may be used, wherein each of the ridges or grooves has a specific-shape in its cross section such as an arc. In this case, the transparent light diffusion body having the aligned ridges or grooves on only one surface thereof can be manufactured at low cost by, for example, an extrusion molding method. Further, even in the case of the transparent light diffusion body having the aligned ridges or grooves on both surfaces thereof opposing each other, when the ridges or grooves are aligned in the same direction between the both surfaces, the transparent light diffusion body can be manufactured at low cost by an extrusion molding method in a similar manner.

On the other hand, due to a diffusion effect obtained by forming the ridges or grooves on both the front surface and the back surface of the transparent light diffusion body in such a manner that the ridges or grooves formed on the front surface cross the ridges or grooves formed on the back surface without imparting the above-mentioned reflecting diffusion function to the first reflection body, the inside of the lighting apparatus can be also hard to be viewed. The transparent light diffusion body having the ridges or grooves formed on the front surface crossing the ridges or grooves formed on the back surface can be manufactured by, for example, an injection-compression method.

The injection-compression method includes injecting a material in a mold in a state where the mold is slightly open, and closing the mold upon completion of the injection of the material. According to the injection-compression method, the material can be supplied at a lower pressure than that in a general injection method which injects a material in a (closed) mold with a high pressure.

Further, the transparent light diffusion body having the ridges or grooves formed on the front surface crossing the ridges or grooves formed on the back surface can be manufactured such that two transparent bodies each having the ridges or grooves formed on one surface are formed by the extrusion molding method, and other surfaces of the two transparent bodies are adhered to each other in such a manner that the ridges or grooves formed on one of the transparent bodies crosses the ridges or grooves formed on another one of the transparent bodies.

In the first to fifth embodiments as described above, the description has been made assuming a case where the lighting apparatus is supported by a horizontal surface such as a ceiling surface and emits light downward. However, the present invention is not limited to such an arrangement. The lighting apparatus may be vertically disposed on a wall surface or the like to emit light horizontally. Alternatively, the lighting apparatus may be disposed at an angle.

Since the lighting apparatus according to the present invention has a high degree of rigidity in particular, the lighting apparatus disposed at any mounting angle can be prevented from deforming or distorting, so that a high-intensity fluorescent tube having a diameter of approximately 16 mm can be used.

The invention claimed is:

1. A lighting apparatus comprising:

at least one rigid elongated hollow cylindrical structure having a longitudinal axis;

a pair of rigid plate-like structures; and at least one straight fluorescent tube, wherein the pair of rigid plate-like structures are firmly fixed to opposite ends of the at least one hollow cylindrical structure, respectively, such that each of the plate-like structures is perpendicular to the longitudinal axis of the at least one hollow cylindrical structure and such that a high rigidity is provided to the lighting apparatus, and wherein the at least one straight fluorescent tube is mounted to the pair of rigid plate-like structures and extends between the pair of rigid plate-like structures in a direction parallel to the longitudinal axis of the at least one hollow cylindrical structure.

2. A lighting apparatus according to claim 1, wherein the at least one rigid elongated hollow cylindrical structure is a plurality of rigid elongated hollow cylindrical structures arranged in parallel to each other, and wherein the opposite ends of the hollow cylindrical structures are fixed to the pair of plate-like structures.

3. A lighting apparatus according to claim 2, wherein the at least one straight fluorescent tube is a plurality of straight fluorescent tubes mounted between the pair of plate-like structures and extending in a direction parallel to the longitudinal axis of each of the hollow cylindrical structures.

4. A lighting apparatus according to claim 2, wherein the at least one straight fluorescent tube is a plurality of straight fluorescent tubes mounted to the hollow cylindrical structures between the pair of plate-like structures such that the fluorescent tubes are perpendicular to the longitudinal axis of each of the hollow cylindrical structures.

5. A lighting apparatus according to claim 1, further comprising at least one panel-like transparent light diffusion body mounted to the plate-like structures, the panel-like transparent light diffusion body forming a radiating surface of the lighting apparatus.

6. A lighting apparatus according to claim 5, wherein the hollow cylindrical structure has a reflecting diffusion function at least at a front surface portion closer to the transparent light diffusion body.

7. A lighting apparatus according to claim 1, further comprising a first reflection body mounted to the plate-like structures for reflecting light emitted from the fluorescent tube to an irradiation region.

8. A lighting apparatus according to claim 7, further comprising a panel-like transparent light diffusion body mounted to the plate-like structures, the panel-like transparent light diffusion body forming a radiation surface of the lighting apparatus, the first reflection body having a reflecting diffusion function at least at a front surface portion closer to the transparent light diffusion body.

9. A lighting apparatus according to claim 7, further comprising a second reflection body for reflecting light emitted from the fluorescent tube toward an inner portion of the lighting apparatus, the fluorescent tube being disposed at end portions of the plate-like structures, the second reflection body being disposed at the end portions of the plate-like structures, and being located outside from the fluorescent tube.

10. A lighting apparatus according to claim 9, further comprising a panel-like transparent light diffusion body mounted to the plate-like structures, the panel-like transparent light diffusion body forming a radiating surface of the lighting apparatus, wherein the first reflection body, the plate-like structures, the light diffusion body, and the second reflection body form an enclosure for the at least one straight fluorescent tube, wherein at least a portion of the second reflection body pivots to open and close the enclosure, and wherein the fluorescent tube can be mounted to and dismounted from the lighting apparatus in a state where the portion of the second reflection body is open.

11. The lighting apparatus of claim 7, further comprising a cover member connected to the plate-like structures, the cover member being disposed radially outwardly of the first reflection body and the at least one elongated hollow cylindrical structure relative to the at least one straight fluorescent tube.

12. A lighting apparatus according to claim 1, further comprising a fixation ring inserted into an end portion of the hollow cylindrical structure, wherein each of the plate-like structures is coupled to the hollow cylindrical structure by fixing the fixation ring to the hollow cylindrical structure and fixing each of the plate-like structures to the fixation ring.

13. A lighting apparatus according to claim 1, wherein each of the plate-like structures has a flat-plate shape.

14. A lighting apparatus according to claim 1, wherein each of the plate-like structures has a bent shape.

15. A lighting apparatus according to claim 1, further comprising a ballast disposed inside the hollow cylindrical structure for lighting the fluorescent tube.

16. The lighting apparatus of claim 1, further comprising:

a cover member connected to the plate-like structures; and a panel-like transparent light diffusion body mounted to the plate-like structures, the panel-like transparent light diffusion body forming a radiating surface of the lighting apparatus; and a first reflection body mounted to the plate-like structures for reflecting light emitted from the fluorescent tube, wherein the at least one hollow cylindrical structure is disposed radially outwardly of the first reflection body relative to the at least one straight fluorescent tube, wherein the cover member is disposed radially outwardly of the at least one hollow cylindrical structure relative to the at least one straight fluorescent tube, and wherein the cover member is on an opposite side of the at least one straight fluorescent tube from the panel-like transparent light diffusion body.

17. A lighting apparatus comprising:

at least one rigid elongated hollow cylindrical structure having a longitudinal axis;

a pair of rigid plate-like structures;

at least one straight fluorescent tube;

a first reflection body mounted to the plate-like structures for reflecting light emitted from the fluorescent tube to an irradiation region; and a panel-like transparent light diffusion body mounted to the plate-like structures, the panel-like transparent light diffusion body forming a radiation surface of the lighting apparatus, wherein the pair of rigid plate-like structures are firmly fixed to opposite ends of the at least one hollow cylindrical structure, respectively, such that each of the plate-like structures is perpendicular to the longitudinal axis of the at least one hollow cylindrical structure and such that a high rigidity is provided to the lighting apparatus, wherein the at least one straight fluorescent tube is mounted to the pair of rigid plate-like structures and extends between the pair of rigid plate-like structures in a direction parallel to the longitudinal axis of the at least one hollow cylindrical structure, and wherein the at least one elongated hollow cylindrical structure is disposed radially outwardly of the first reflection body relative to the at least one straight fluorescent tube such that the at least one elongated cylinder is on an opposite side of the first reflection body than the at least one fluorescent tube.

18. The lighting apparatus of claim 17, further comprising a cover member connected to the plate-like structures, the cover member being disposed radially outwardly of the first reflection body and the at least one elongated hollow cylindrical structure relative to the at least one straight fluorescent tube.

19. A lighting apparatus comprising:

at least one rigid elongated hollow cylindrical structure having a longitudinal axis;

a pair of rigid plate-like structures;

at least one straight fluorescent tube;

a first reflection body mounted to the plate-like structures for reflecting light emitted from the fluorescent tube to an irradiation region;

a second reflection body for reflecting light emitted from the fluorescent tube toward an inner portion of the lighting apparatus; and a panel-like transparent light diffusion body mounted to the plate-like structures, the panel-like transparent light diffusion body forming a radiation surface of the lighting apparatus, wherein the pair of rigid plate-like structures are firmly fixed to opposite ends of the at least one hollow cylindrical structure, respectively, such that each of the plate-like structures is perpendicular to the longitudinal axis of the at least one hollow cylindrical structure and such that a high rigidity is provided to the lighting apparatus, wherein the at least one straight fluorescent tube is mounted to the pair of rigid plate-like structures and extends between the pair of rigid plate-like structures in a direction parallel to the longitudinal axis of the at least one hollow cylindrical structure, wherein the first reflection body, the plate-like structures, the light diffusion body, and the second reflection body form an enclosure for the at least one straight fluorescent tube, wherein at least a portion of the second reflection body is movable between an open state and a closed state to open and close the enclosure, and the fluorescent tube can be mounted to and dismounted from the lighting apparatus in the open state of the second reflection body.

20. The lighting apparatus of claim 19, further comprising a hinge, wherein the second reflection body is pivotable about the hinge to move between the open state and the closed state.

* * * * *